US012203469B2

(12) United States Patent
Lee et al.

(10) Patent No.: US 12,203,469 B2
(45) Date of Patent: Jan. 21, 2025

(54) DEVICE FOR CANCELING ACOUSTIC NOISE GENERATED BY A PUMP

(71) Applicant: Toyota Motor Engineering & Manufacturing North America, Inc., Plano, TX (US)

(72) Inventors: Taehwa Lee, Ann Arbor, MI (US); Xiaopeng Li, Ann Arbor, MI (US); Ryohei Tsuruta, Ann Arbor, MI (US); Michael Paul Rowe, Pinckney, MI (US); Danil V. Prokhorov, Canton, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 239 days.

(21) Appl. No.: 17/702,208

(22) Filed: Mar. 23, 2022

(65) Prior Publication Data

US 2023/0077854 A1 Mar. 16, 2023

Related U.S. Application Data

(60) Provisional application No. 63/243,826, filed on Sep. 14, 2021.

(51) Int. Cl.

| | |
|---|---|
| ***F04B 53/00*** | (2006.01) |
| ***F04B 43/04*** | (2006.01) |
| ***F04B 53/16*** | (2006.01) |

(52) U.S. Cl.

CPC ..... *F04B 53/004* (2013.01); *F04B 43/043* (2013.01); *F04B 53/16* (2013.01)

(58) Field of Classification Search

CPC .... F04B 53/004; F04B 43/043; F04B 43/095; F04B 53/16; F04B 39/0066; F04B 39/0088; F04B 39/123; F04B 45/047; F04B 19/006; F04B 45/06; F04B 45/067; F04B 39/0027; F04B 39/0055; F04B 39/0061; F04B 43/046

(Continued)

(56) References Cited

U.S. PATENT DOCUMENTS 2,570,241 A * 10/1951 Hutchinson ..... F04B 11/0091 417/540

5,340,275 A 8/1994 Eisinger (Continued)

FOREIGN PATENT DOCUMENTS

CN 101419794 A 4/2009
CN 111110215 A 5/2020

(Continued)

*Primary Examiner* — Forrest M Phillips
*Assistant Examiner* — Jennifer B. Olson
(74) *Attorney, Agent, or Firm* — Christopher G. Darrow; Darrow Mustafa PC

(57) ABSTRACT

A device for canceling acoustic noise generated includes, in one example, an inlet channel configured to be fluidly connected to an inlet port of a pump and an outlet channel configured to be fluidly connected to an outlet port of the pump. The device also includes an inlet resonator and an outlet resonator, both having open ends and closed ends. The open ends of the inlet and outlet resonators are fluidly connected to the inlet and outlet channels, respectively. When in operation, the inlet and outlet resonators can cancel noise generated by the operation of the pump.

15 Claims, 4 Drawing Sheets

(58) Field of Classification Search
USPC ..... 181/266, 286, 250, 273, 276; 417/312, 417/540, 541, 542
See application file for complete search history.

(56) References Cited

U.S. PATENT DOCUMENTS

| | | | | |
|---|---|---|---|---|
| 6,009,705 | A * | 1/2000 | Arnott | G10K 11/172 60/322 |
| 6,700,338 | B2 * | 3/2004 | Sugimoto | F25B 9/145 318/114 |
| 7,094,040 | B2 * | 8/2006 | Higashino | F16K 99/0015 417/540 |
| 9,790,937 | B2 * | 10/2017 | Morrison | F04B 39/0066 |
| 11,255,322 | B2 * | 2/2022 | Mou | H04M 1/035 |
| 2019/0011391 | A1 * | 1/2019 | Mou | F04B 19/006 |

FOREIGN PATENT DOCUMENTS

| | | | |
|---|---|---|---|
| CN | 111140478 | A | 5/2020 |
| CN | 210660518 | U | 6/2020 |
| CN | 113107817 | A | 7/2021 |

* cited by examiner

DEVICE FOR CANCELING ACOUSTIC NOISE GENERATED BY A PUMP

CROSS-REFERENCE TO RELATED APPLICATION

This application claims the benefit of U.S. Provisional Patent Application No. 63/243,826, filed Sep. 14, 2021, which is hereby incorporated by reference in its entirety.

TECHNICAL FIELD

The subject matter described herein relates in general to devices for canceling noise generated by the operation of a pump and, more specifically, to devices for canceling noise generated by the operation of a micropump.

BACKGROUND

The background description provided is to present the context of the disclosure generally. Work of the inventor, to the extent it may be described in this background section, and aspects of the description that may not otherwise qualify as prior art at the time of filing, are neither expressly nor impliedly admitted as prior art against the present technology.

Pumps, such as micropumps, move fluids, such as gases, liquids, and/or slurries. Typically, pumps convert electrical energy into hydraulic energy to raise, transport, or compress fluids. During their operation, pumps emit noise caused by vibrations in the piping or channels leading to/from the pump and the pump casing. These vibrations interact with the surrounding air and are perceived as airborne sound. Generally, in the case of micropumps, noise generated from micropumps have frequencies in the low to medium range, which is approximately 2000 Hz or less.

SUMMARY

This section generally summarizes the disclosure and does not comprehensively explain its full scope or all its features.

In one embodiment, a device for canceling acoustic noise generated by a pump includes an inlet channel configured to be fluidly connected to an inlet port of a pump and an outlet channel configured to be fluidly connected to an outlet port of the pump. The device also includes an inlet resonator and an outlet resonator, which may both have open ends and closed ends. The open ends of the inlet and outlet resonators are fluidly connected to the inlet and outlet channels, respectively. When in operation, the inlet and outlet resonators can cancel noise generated by the pump.

In another embodiment, a device for canceling acoustic noise may include a pump with an inlet port and an outlet port configured to draw fluid from the inlet port and discharge the fluid from the outlet port. The device may further include an inlet channel having an inlet resonator fluidly connected to the inlet port and an outlet channel having an outlet resonator fluidly connected to the outlet port. The device may further include a housing in which the pump, inlet resonator, and outlet resonator are disposed within. A housing resonator may also be disposed of within the housing. Like before, when in operation, the inlet, outlet, and housing resonators can cancel noise generated by the pump.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Disclosed is a device for canceling sound generated during the operation of a pump. Pumps, such as micropumps, generate sound during their operation. In the case of micropumps, the sound generated by the operation of the micropump is typically in the low to medium range, which is approximately 2000 Hz or less. In one example, the device includes both inlet and outlet resonators that are fluidly connected to the inlet and outlet channels of the pump, respectively. The inlet and outlet resonators may be quarter-wavelength resonators that have resonant frequencies the same or similar to the frequencies of sounds generated during the operation of the pump. The device may also include a housing that encloses the pump and the inlet and outlet resonators. Further still, the device may also include a housing resonator located within the housing that also functions to cancel sounds generated during the operation of the pump.

Figure 1:
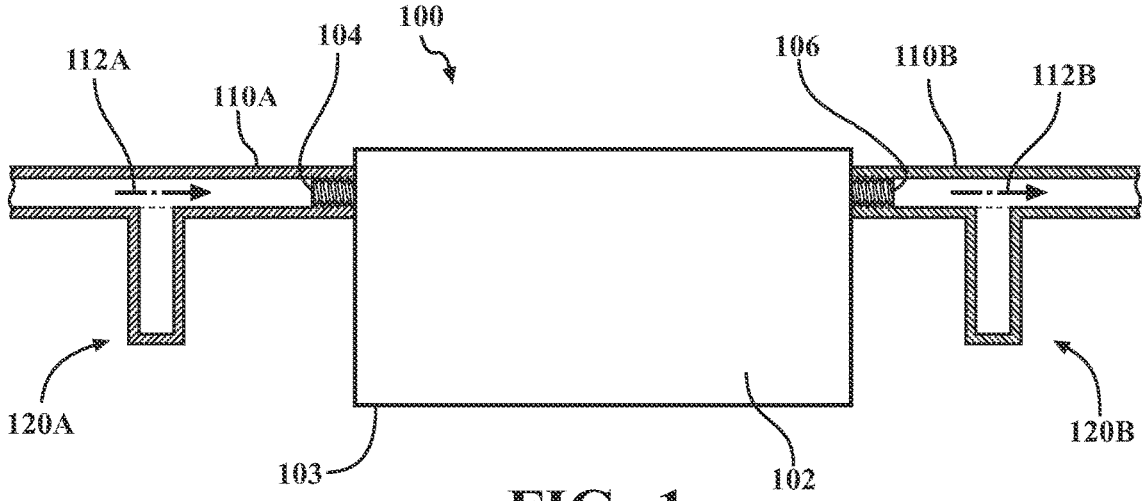
FIG. 1 illustrates an example of a device for canceling sound generated by a pump by utilizing inlet and outlet resonators.

Referring to FIG. 1, illustrated is one example of a device 100 for canceling sound generated during the operation of a pump. In this example, the device 100 includes a pump 102 configured to move fluid from an inlet port 104 to an outlet port 106. The fluid that can be moved by the pump 102 can include gases, liquids, and/or slurries. The pump 102, in this example, converts electrical energy into hydraulic energy to raise, transport, or compress fluids.

In one example, the pump 102 may be a micropump. Micropumps are pumps that control and manipulate small fluid volumes. A micropump may have functional dimensions within the micrometer range. The micropump may be mechanical or nonmechanical. In the case of situations where the micropump is a mechanical micropump, the micropump may be a diaphragm micropump that includes a diaphragm that by repeated actuation of the diaphragm drives the fluid. When the diaphragm is deflected upwards through a driving force, fluid is pulled into the inlet port 104 and provided to the main pump valve. When the diaphragm is lowered, fluid is expelled through the outlet port 106.

In another example of a mechanical micropump, the micropump may be a piezoelectric micropump. This type of micropump relies on the electromechanical property of piezo ceramic to deform in response to an applied voltage. A piezoelectric disk attached to a membrane causes diaphragm deflection driven by the external axial electric field, resulting in pressure variation in the chamber, which causes fluid inflow from the inlet port 104 and fluid outflow to the outlet port 106.

The device 100 may also include an inlet channel 110A connected to the inlet port 104 and an outlet channel 110B connected to the outlet port 106. The inlet channel 110A functions to provide a conduit or piping for guiding fluid towards the inlet port 104, as indicated by arrow 112A. Similarly, the outlet channel 110B functions to provide a conduit or piping for guiding fluid away from the outlet port 106, as indicated by the arrow 112B.

As mentioned previously, during the operation of the pump 102, the pump 102 may emit sound caused by vibrations in the inlet channel 110A and/or outlet channel 110B and/or the pump casing 103. These vibrations interact with the surrounding air and are perceived as airborne sound.

To cancel or partially cancel sounds emitted during the operation of the pump 102, resulting in quieter operation of the pump 102, the device 100 also includes an inlet resonator 120A and an outlet resonator 120B. In this example, the inlet resonator 120A and/or the outlet resonator 120B may be quarter-wavelength resonators. However, other types of resonators may also be considered as well, such as Helmholtz resonators. The inlet resonator 120A and/or the outlet resonator 120B can be either absorptive or reflective. A reflection type resonator may be used for its simplicity, as this type of resonator includes a single lossless resonator. On the other hand, an absorptive resonator may require a pair of resonators for perfect sound absorption at residence. The lossless resonator can be realized by using a larger width relative to the width of the inlet resonator 120A and the outlet resonator 120B.

Figure 2:
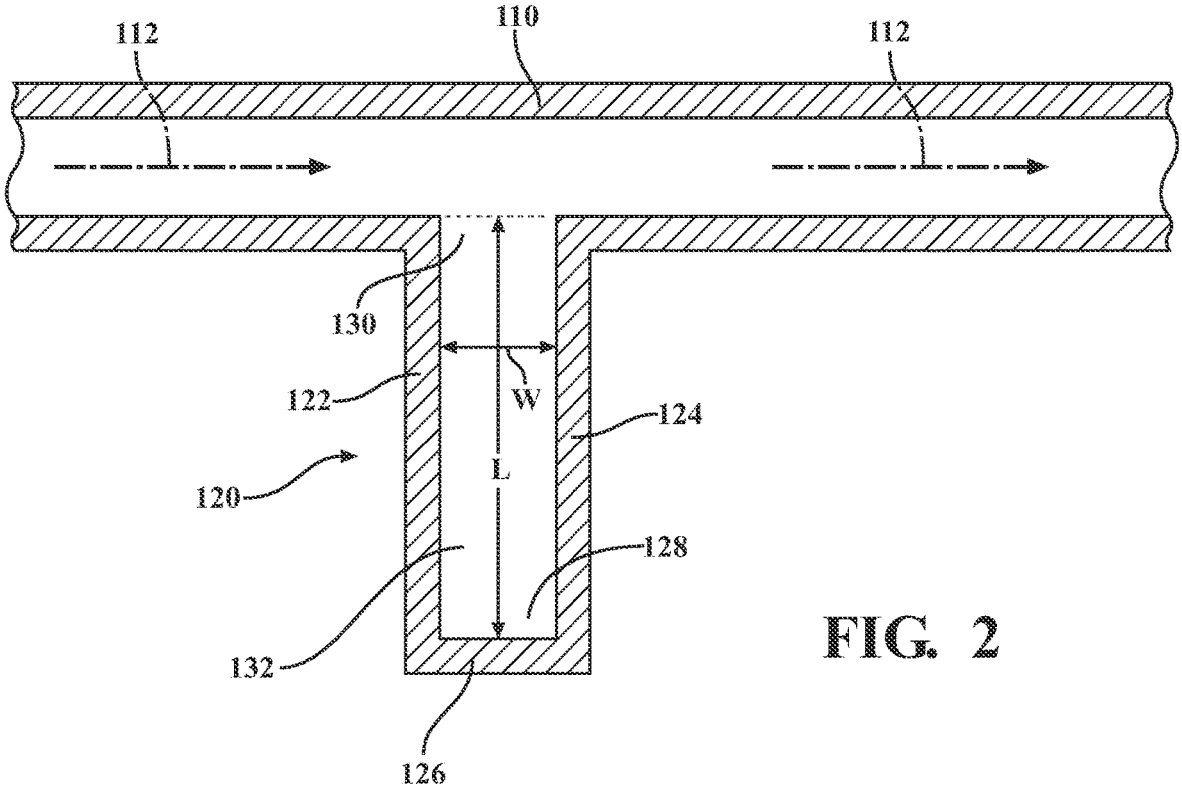
FIG. 2 illustrates a more detailed view of a resonator that may be utilized as an inlet or outlet resonator.

FIG. 2 illustrates a more detailed view of a resonator 120, which may be similar to the inlet resonator 120A and/or the outlet resonator 120B. As such, the description given for the resonator 120 can be applied to the inlet resonator 120A and/or the outlet resonator 120B. Here, illustrated is a channel 110, which may be similar to either the inlet channel 110A and/or outlet channel 110B leading to/from the pump 102. Here, the resonator 120 is a quarter wavelength resonator. The resonator 120 includes sidewalls 122 and 124 that generally define a cavity 132 of the resonator 120. The resonator 120 also has a closed end 128 defined by an end wall 126. Opposite the closed end 128 is an open end 130 that places the cavity 132 of the resonator 120 in fluid communication with the channel 110. Generally, the width W of the cavity 132 is substantially equal to the width of the open end 130. As such, fluid flowing within the channel 110, as indicated by the arrows 112, can enter the cavity 132 of the resonator 120.

The length L of the resonator 120 can be expressed as $L=(c/f_{res})/4$, wherein L is the length of the resonator 120, c is the speed of sound, and $f_{res}$ is a resonant frequency of the resonator 120. The resonant frequency $f_{res}$ of the resonator 120 may be selected based on the frequency of the sound to be canceled. For example, if the frequency of sound generated during the operation of the pump 102 causes the channel 110 to vibrate and emit a sound having a frequency of 1000 Hz, the resonant frequency $f_{res}$ of the resonator 120 may be selected to be 1000 Hz. In this situation, if one assumes the speed of sound c to be 343 m/s and the $f_{res}$ to be 1000 Hz, the length L of the resonator 120 would be approximately 8.5 cm. As such, the resonator 120 having a length L of 8.5 cm would be able to cancel, at least partially, the sound emitted by the vibration of the channel 110 having a frequency of approximately 1000 Hz.

It should be understood that while the dimensions of the inlet resonator 120A and the outlet resonator 120B in FIG. 1 are illustrated to be similar and thus have similar resonant frequencies, the lengths of the inlet resonator 120A and the outlet resonator 120B may be different based on different vibration characteristics of the inlet channel 110A and the outlet channel 110B during the operation of the pump 102. For example, suppose the inlet channel 110A vibrates such that it produces a sound having a frequency of 1000 Hz and the outlet channel 110B vibrates such that it produces a sound having a frequency of 2000 Hz. In that case, the length of the cavity of the inlet resonator 120A may be 8.5 cm, while the length of the cavity of the outlet resonator 120B may be approximately 4.35 cm.

The pump 102 may be able to operate at different speeds. When the pump 102 operates at different speeds, the vibration of the inlet channel 110A and/or outlet channel 110B may change, thus causing sound emitted by the vibration of the inlet channel 110A and/or outlet channel 110B to also change. To cancel out sounds having different frequencies caused by operating the pump 102 at different speeds, multiple inlet and/or outlet resonators may be utilized.

Figure 3A:
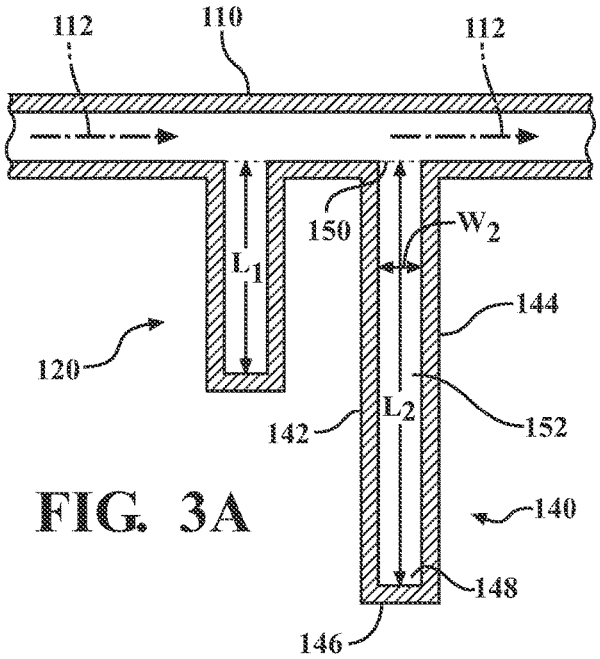
FIGS. 3A-3C illustrate examples of using multiple resonators having different lengths for canceling sounds having different frequencies.

For example, referring to FIG. 3A, illustrated as one example of a channel 110 that acts as a conduit for guiding fluid, as indicated by the arrows 112. In this example, the channel 110, like before, can be the inlet channel 110A or the outlet channel 110B. Here, the channel 110 includes a resonator 120 that may be similar to the resonator 120 previously described in FIG. 2. However, in addition to the resonator 120, also illustrated is a second resonator 140 that can cancel out sounds having a different frequency than those sounds canceled out by the resonator 120.

Generally, the second resonator 140 is similar to the resonator 120. As such, the second resonator 140 has sidewalls 142 and 144 that generally define a cavity 152 of the second resonator 140. The second resonator 140 also has a closed end 148 defined by an end wall 146. Opposite the closed end 148 is an open end 150 that places the cavity 152 of the second resonator 140 in fluid communication with the channel 110. Generally, the width $W_2$ of the cavity 152 is substantially equal to the width of the open end 150. As such, fluid flowing within the channel 110, as indicated by the arrows 112, can enter the cavity 152 of the second resonator 140.

The second resonator 140 has a different resonant frequency than the resonator 120. Moreover, as explained earlier, the resonant frequency of the resonator 120 is approximately 1000 Hz, while, in this example, the resonant frequency of the second resonator is 2000 Hz. Using the equation as $L=(c/f_{res})/4$, the length $L_2$ of the second resonator 140 would be approximately 4.35 cm. However, it should be understood that the length of the resonator 120 and/or the second resonator 140 can vary from application to application based on the frequency of the sound or sounds one wishes to cancel.

In the example shown in FIG. 3A, the resonator 120 and the second resonator 140 are separated from each other along the length of the channel 110. However, the resonator 120 and the second resonator 140 may be separated from each other in other ways as well. For example, referring to FIG. 3B, the resonator 120 and the second resonator 140 are separated from each other along a radial direction. Further still, referring to FIG. 3C, the resonator 120 and the second resonator 140 are separated from each other along the length of the channel 110 and in a radial direction.

Figure 3B:
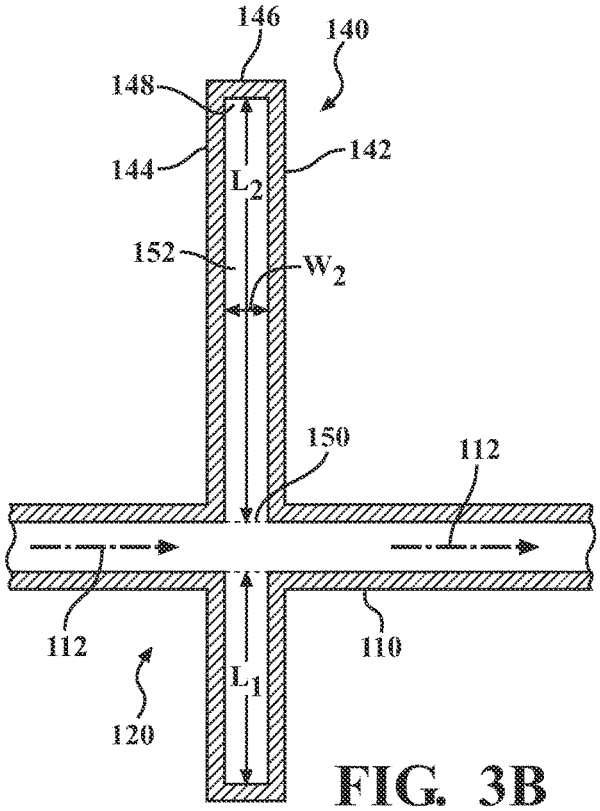
Figure 3C:
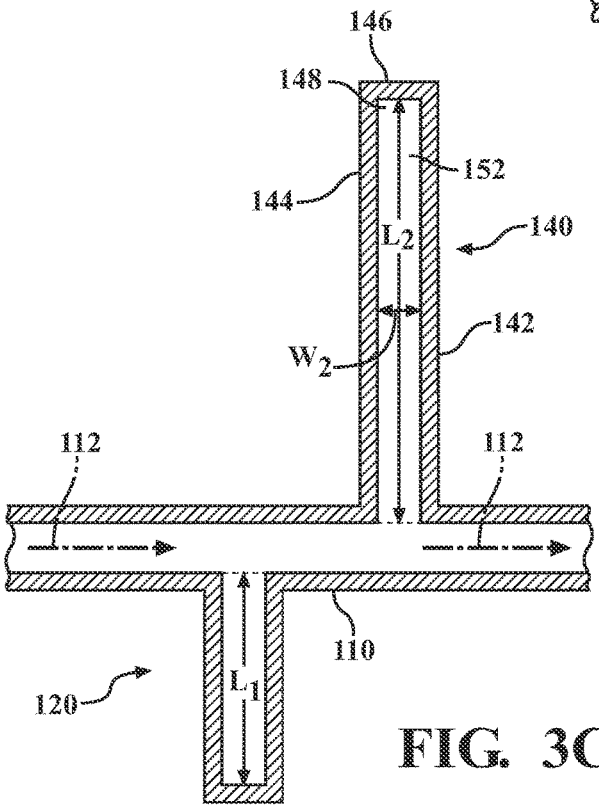

Additionally, in the example shown in FIGS. 3A-3C, only two resonators, the resonator 120 in the second resonator 140, are shown. However, it should be understood that any number of resonators could be utilized. As such, if a broad range of sounds having different frequencies were to be canceled out, numerous resonators may be utilized, not just one or two resonators.

Figure 4:
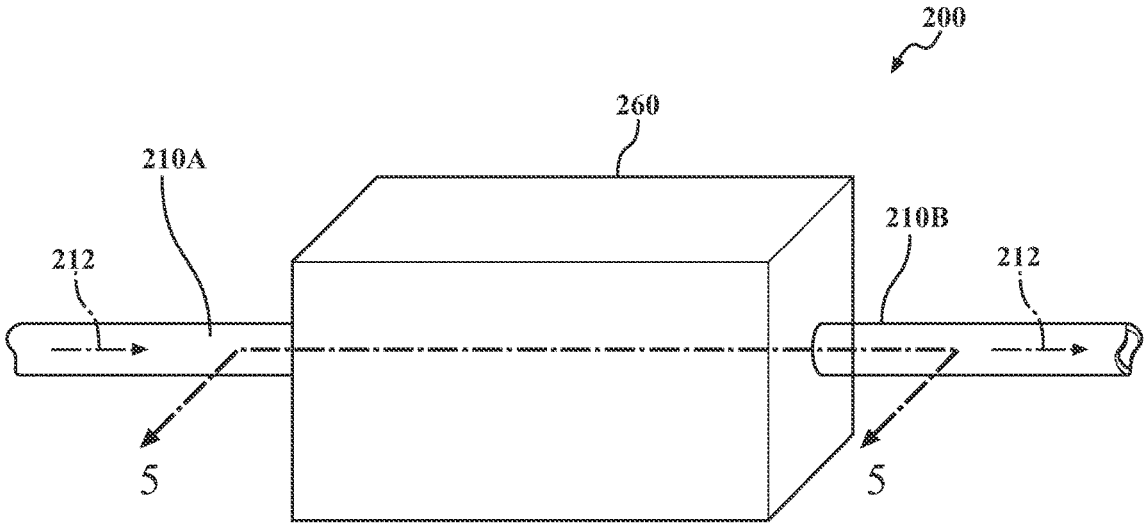
FIG. 4 illustrates another example of the device for canceling sound generated by the pump.
Figure 5:
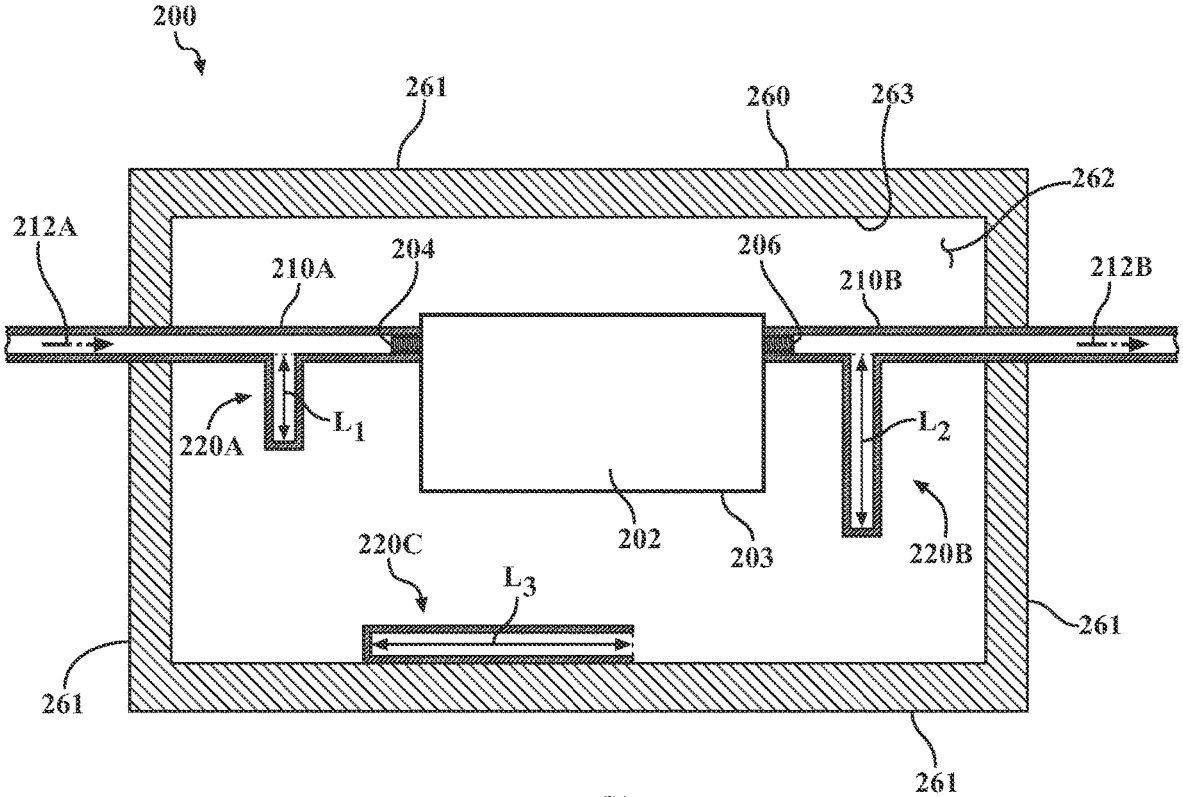
FIG. 5 illustrates a cut-away view of the device of FIG. 4, illustrating the placement of inlet, outlet, and housing resonators within the housing.

Referring to FIGS. 4 and 5, another example of a device 200 for canceling sound generated by the operation of the pump is shown. Like reference numerals have been utilized to refer to like elements with the exception that these reference numerals have been incremented by 100. Unless otherwise stated, any previous description regarding these elements is equally applicable to the device 200. Here, the device 200 illustrates an inlet channel 210A extending into a housing 260 and an outlet channel 210B extending from the housing 260.

As best shown in FIG. 5, the housing 260 includes wall portions 261 that define an interior space 262. Depending on the spaciousness of the interior space 262, the housing 260 can also act as an acoustic cavity resonator, exhibiting resonant modes that can be utilized to cancel out sounds generated by the operation of the pump 202.

Generally, a pump 202 is located within the interior space 262 may be attached to an interior wall 263 of the housing 260. The pump 202 is similar to the pump 102 previously explained and can be a micropump. As such, the inlet channel 210A is fluidly connected to an inlet port 204 of the pump 202, while the outlet channel 210B is fluidly connected to the outlet port 206 of the pump 202. The inlet channel 210A acts as a conduit for guiding fluid into the pump 202 as indicated by arrow 212A, while the outlet channel 210B acts as a conduit for guiding fluid from the pump 202, as indicated by the arrow 212B.

Also disposed within the interior space 262 of the housing 260 is an inlet resonator 220A and an outlet resonator 220B. Similar to the inlet resonator 120A and the outlet resonator 120B previously described, the inlet resonator 220A and the outlet resonator 220B are fluidly connected to the inlet channel 210A and the outlet channel 210B, respectively. In this example, the outlet resonator 220B has a length $L_2$ approximately twice the length of the inlet resonator 220A. As such, the resonant frequency of the inlet resonator 220A is approximately twice that of the outlet resonator 220B. However, the lengths of the inlet resonator 220A and the outlet resonator 220B may vary from application to application. In some applications, the lengths may be equal, while in other applications, the lengths may be different.

Also, in this example, the inlet resonator 220A and the outlet resonator 220B only include one resonator each. However, similar to what was described in FIGS. 3A-3C, multiple resonators may be attached to the inlet channel 210A and/or the outlet channel 210B to cancel out sounds having different frequencies, which may occur when the pump 202 is operated at different speeds.

The device 200 also includes a housing resonator 220C. The housing resonator 220C, like the inlet resonator 220A and the outlet resonator 220B, may be a quarter-wavelength resonator. The purpose of the housing resonator 220C is to cancel out other sounds caused by the vibration of the pump 202 when in operation. Moreover, the casing 203 of the pump 202 then closes the working components of the pump 202 may vibrate, resulting in the generation of sound. The housing resonator 220C may have a resonant frequency substantially similar to the frequency of the sound emitted by the vibration of the casing 203 of the pump 202

Figure 6:
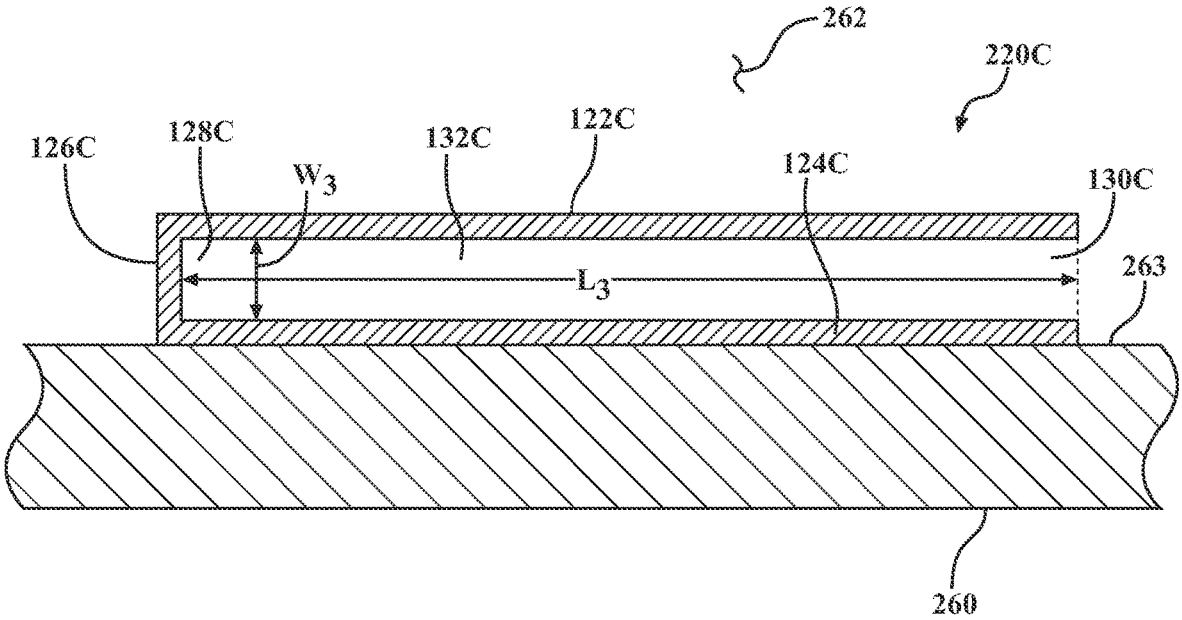
FIG. 6 illustrates a more detailed view of the housing resonator of the device of FIGS. 4 and 5.

FIG. 6 illustrates a more detailed view of the housing resonator 220C. Like the other resonators described in this description, the housing resonator 220C includes sidewalls 122C and 124C that generally define a cavity 132C of the housing resonator 220C. The housing resonator 220C also has a closed end 128C defined by an end wall 126C. Opposite the closed end 128C is an open end 130C that places the cavity 132C of the housing resonator 220C in fluid communication with the interior space 262. Generally, the width $W_3$ of the cavity 132C is substantially equal to the width of the open end 130C.

The resonant frequency of the housing resonator 220C, like the other resonators described in this description, is defined by the length $L_3$ of the cavity 132C. In this example, the length $L_3$ of the cavity 132C may result in the housing resonator 220C having a resonant frequency substantially equal to the frequency of the sound emitted by the vibration of the casing 203 caused by the operation of the pump 202. The sound canceling effect caused by the housing resonator 220C may result from friction between the housing resonator 220C and the air vibrating inside the housing 260. The amount of sound that the housing resonator 220C can cancel may be based on the width $W_3$ of the housing resonator 220C with respect to the size of the interior space 262. At an appropriate width, the housing resonator 220C functions as an absorptive resonator at the frequency determined by the length $L_3$.

The housing resonator 220C is generally attached to an interior wall 263 of the housing 260. In this example, the sidewall 124C is attached to the interior wall 263 of the housing. Any methodology for attaching the housing resonator 220C to the interior wall 263 may be utilized. Furthermore, instead of attaching the sidewall 124C to the interior wall 263, other portions of the housing resonator 220C may be attached to the interior wall 263, such as the end wall 126C. Further still, instead of attachment, the housing resonator 220C may be formed as a unitary component of the housing 260.

It should also be understood that while only one housing resonator 220C is shown, the device 200 may include multiple housing resonators located within the interior space 262. Moreover, the multiple housing resonators may have different resonant frequencies and, therefore, different lengths to cancel out a broad range of sounds having different frequencies, which may occur when the pump 202 is operated at different speeds.

As such, the embodiments described in this disclosure utilize resonators to cancel sound emitted during the operation of the pump. In particular, micropumps emit sounds having medium to low frequencies, which can be undesirable. The embodiments of the devices described in this disclosure can reduce and/or eliminate these undesirable noises.

Detailed embodiments are disclosed herein. However, it is understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations.

The following includes definitions of selected terms employed herein. The definitions include various examples and/or forms of components that fall within the scope of a term and may be used for various implementations. The examples are not intended to be limiting. Both singular and plural forms of terms may be within the definitions.

References to "one embodiment," "an embodiment," "one example," "an example," and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

The terms "a" and "an," as used herein, are defined as one or more than one. As used herein, "plurality" is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC, or ABC).

Aspects herein can be embodied in other forms without departing from the spirit or essential attributes. Accordingly, reference should be made to the following claims, rather than to the foregoing specification, as indicating the scope hereof.

What is claimed is:

1. A device comprising:

a pump having an inlet port and an outlet port, wherein the pump is configured to draw liquid from the inlet port and discharge the liquid from the outlet port;

an inlet channel connected to the inlet port and having an inlet resonator that includes an open end and a closed end;

an outlet channel connected to the outlet port and having an outlet resonator that includes an open end and a closed end;

a housing, wherein the pump, the inlet resonator, and the outlet resonator are located within an inside space defined by the housing; and a housing resonator having an open end and a closed end, the housing resonator being disposed within the inside space defined by the housing, wherein the housing resonator is not fluidly connected to the inlet resonator or the outlet resonator, the housing resonator having a resonant frequency substantially equal to a frequency of a sound emitted by a vibration of a casing of the pump caused by the operation of the pump.

2. The device of claim 1, wherein the inlet resonator and the outlet resonator are quarter-wavelength resonators having different lengths.

3. The device of claim 2, wherein lengths of at least one of the inlet resonator and the outlet resonator are defined by $L=(c/f_{res})/4$, wherein L is the lengths of at least one of the inlet resonator and the outlet resonator, c is the speed of sound, and $f_{res}$ is a resonant frequency of the at least one of the inlet resonator and the outlet resonator.

4. The device of claim 1, wherein the housing resonator is a quarter wavelength resonator.

5. The device of claim 4, wherein a length of the housing resonator is defined by $L=(c/f_{res})/4$, wherein L is the length of the housing resonator, c is the speed of sound, and $f_{res}$ is a resonant frequency of the housing resonator.

6. The device of claim 1, wherein:

the inlet resonator comprises a plurality of inlet resonators each having open ends and closed ends, wherein the open ends of the plurality of inlet resonators are fluidly connected to the inlet channel, and the plurality of inlet resonators having resonant frequencies that differ from one another.

7. The device of claim 6, wherein the plurality of inlet resonators are spaced apart in at least one of a radial direction and a lengthwise direction defined by the length of the inlet channel.

8. The device of claim 1, wherein:

the outlet resonator comprises a plurality of outlet resonators each having open ends and closed ends, wherein the open ends of the plurality of outlet resonators are fluidly connected to the outlet channel; and the plurality of outlet resonators having resonant frequencies that differ from one another.

9. The device of claim 8, wherein the plurality of outlet resonators are spaced apart in at least one of a radial direction and a lengthwise direction defined by the length of the outlet channel.

10. The device of claim 1, wherein the pump is a micropump.

11. A system comprising:

an inlet channel configured to be connected to an inlet port of a pump, the inlet channel having an inlet resonator with an open end and a closed end;

an outlet channel configured to be connected to an outlet port of the pump, the outlet channel having an outlet resonator with an open end and a closed end;

wherein the pump is configured to pump liquid from the inlet port to the outlet port;

a housing, wherein the inlet resonator and the outlet resonator are located within an inside space defined by the housing;

a housing resonator having an open end and a closed end, the housing resonator being disposed within the inside space defined by the housing, wherein the housing resonator is not fluidly connected to the inlet resonator or the outlet resonator; and the housing resonator having a resonant frequency substantially equal to a frequency of a sound emitted by a vibration of a casing of the pump caused by the operation of the pump.

12. The system of claim 11, wherein the inlet resonator and the outlet resonator are quarter-wavelength resonators having different lengths.

13. The system of claim 11, wherein:

the inlet resonator comprises a plurality of inlet resonators each having open ends and closed ends, wherein the open ends of the plurality of inlet resonators are fluidly connected to the inlet channel; and the plurality of inlet resonators having resonant frequencies that differ from one another.

14. The system of claim 11, wherein:

the outlet resonator comprises a plurality of outlet resonators each having open ends and closed ends, wherein the open ends of the plurality of outlet resonators are fluidly connected to the outlet channel; and the plurality of outlet resonators having resonant frequencies that differ from one another.

15. The system of claim 11, wherein the pump is a micropump.

* * * * *